US006634404B2

(12) United States Patent
Simon

(10) Patent No.: US 6,634,404 B2
(45) Date of Patent: Oct. 21, 2003

(54) SET-DOWN BOX

(75) Inventor: Rainer Simon, Eschenburg-Eiershausen (DE)

(73) Assignee: Convenience Food Systems Wallau GmbH & Co. KG, Biedenkopf-Wallau (DE)

( * ) Notice: Subject to any disclaimer, the term of this patent is extended or adjusted under 35 U.S.C. 154(b) by 130 days.

(21) Appl. No.: 09/920,031

(22) Filed: Aug. 1, 2001

(65) Prior Publication Data

US 2002/0043345 A1 Apr. 18, 2002

(30) Foreign Application Priority Data

Aug. 1, 2000 (DE) ..... 100 37 864

(51) Int. Cl.[7] ..... B65C 9/08; B65C 9/26; B65C 9/36

(52) U.S. Cl. ..... 156/556; 156/557; 156/566; 156/580; 156/DIG. 28; 156/DIG. 37; 156/DIG. 42

(58) Field of Search ..... 156/556, 557, 156/580, DIG. 42, 538, 539, 540, 541, 542, 566, DIG. 24, DIG. 28, DIG. 37, DIG. 41

(56) References Cited

U.S. PATENT DOCUMENTS

| | | | | | |
|---|---|---|---|---|---|
| 4,046,613 | A | * | 9/1977 | Kucheck et al. | 156/249 |
| 4,324,608 | A | * | 4/1982 | Klinger | 156/351 |
| 4,397,709 | A | * | 8/1983 | Schwenzer | 156/351 |
| 4,557,783 | A | * | 12/1985 | Grone et al. | 156/257 |
| 5,281,296 | A | * | 1/1994 | Beliveau | 156/542 |
| 5,300,181 | A | | 4/1994 | Yamaguchi | |
| 5,309,695 | A | * | 5/1994 | Frabetti et al. | 53/136.1 |
| 5,824,183 | A | | 10/1998 | Crankshaw | |
| 6,332,489 | B1 | * | 12/2001 | Kusano | 156/542 |

FOREIGN PATENT DOCUMENTS

| | | |
|---|---|---|
| DE | 1 761 577 | 6/1968 |
| DE | 77 17 056 U | 5/1977 |
| DE | 37 84 102 T2 | 4/1987 |
| DE | 87 06 948.2 | 5/1987 |
| DE | 197 44 927 C1 | 10/1997 |
| EP | 0 837 000 | 4/1998 |
| WO | WO 97/32785 | 9/1997 |

* cited by examiner

*Primary Examiner*—Curtis Mayes
*Assistant Examiner*—Sue A. Purvis
(74) *Attorney, Agent, or Firm*—Oppedahl & Larson LLP

(57) ABSTRACT

The present invention relates to a set-down box of a labelling machine, including:

a conveyor means used to place the labels over the articles to be labelled;

a vertically displaceable pressing means used to press the labels on the articles to be labelled;

a means used to vertically displace the pressing means;

a motor with clockwise and anti-clockwise rotation; and a driving means transmitting the driving power of the motor to the conveyor means and to the means used to vertically displace the pressing means;

wherein the means used to vertically displace the pressing means has a free-wheel in one direction of rotation of the motor.

11 Claims, 2 Drawing Sheets

SET-DOWN BOX

The present invention relates to a set-down box of a labelling machine, including:

- a conveyor means used to place the labels over the articles to be labelled;
- a vertically displaceable pressing means used to press the labels on the articles to be labelled;
- a means used to vertically displace the pressing means;
- a motor with clockwise and anti-clockwise rotation; and
- a driving means transmitting the driving power of the motor to the conveyor means and to the means used to vertically displace the pressing means;

wherein the means used to vertically displace the pressing means has a free-wheel in one direction of rotation of the motor.

Packaged articles, e.g. foods, are provided with labels nowadays. As a rule, such labels are unrolled from a dispenser, placed over the articles to be labelled, and then pressed thereagainst so as to firmly adhere thereon. The currently available set-down boxes have several driving units and are highly complex and large in design.

It was therefore the object to provide a set-down box which would not involve the drawbacks of prior art and would be simple to produce.

According to the invention, said object is accomplished by means of a set-down box of a labelling machine, including:

- a conveyor means used to place the labels over the articles to be labelled;
- a vertically displaceable pressing means used to press the labels on the articles to be labelled;
- a means used to vertically displace the pressing means;
- a motor with clockwise and anti-clockwise rotation; and
- a driving means transmitting the driving power of the motor to the conveyor means and to the means used to vertically displace the pressing means;

wherein the means used to vertically displace the pressing means has a free-wheel in one direction of rotation of the motor.

The driving means for the conveyor means and for the means used to vertically displace the pressing means preferably is free of slip. It is particularly preferred that the driving means be a toothed belt or a chain.

The pressing means can both be lowered and lifted by the means for vertically displacing the pressing means. In a preferred embodiment of the present invention, however, the pressing means has a return spring pressing the pressing means from a deflected end position back into the starting position. In a preferred embodiment, the pressing means has a vertical guide. This guide preferably is comprised of one or more spherical shells.

The conveyor means is used to place the labels over the articles to be labelled. To this end, the conveyor means either must have means making the labels adhere to the conveyor means, or, an air stream and/or a vacuum must be generated holding the labels against the conveyor means by pressure and/or suction. The conveyor means is driven by a driving means. In a preferred embodiment, the conveyor means consists of several conveyor belts being from 2 to 10 mm in width and essentially extending across the entire width of the respective packaging machine. The conveyor belts preferably are spaced apart by 2 to 10 mm.

Any means is suitable as pressing means that allows pressing the labels on the articles to be labelled, so that the adhesive layer located beneath the labels can make better contact with the articles. The pressing means preferably is a pressing plate as described below.

In a preferred embodiment, the means used to vertically displace the pressing means is a lever arm, a cam rotatable at its one end about an axis, which lever arm/cam is driven by said driving means and has a free-wheel in one moving direction of the driving means.

In particular, a stepper motor is suitable as motor, which preferably is computer-controlled.

The set-down box of the invention is advantageous in that its production is easy and convenient and that it has only one driving unit. It is efficient in terms of energy, and no pressurized air is required to press on the labels. Not more than one unit has to be controlled by a control.

The present invention is also directed to a pressing plate having a plurality of plungers displaceable relative to the pressing plate. The plungers preferably are sprung in a bearing, preferably in a shell. Resilience can also be provided using helical springs or disc springs, or compressible media such as air.

The pressing plate of the invention is advantageous in that unevenness in the contour of the articles to be labelled can be compensated very well. The pressing plate according to the invention can be produced in an easy and convenient fashion.

The present invention is also directed to a method of attaching labels on articles to be labelled using the set-down box of the invention, said method consisting of a succession of the following steps:

1. positioning the labels over the articles to be labelled using the motor-driven conveyor means;
2. reversing the moving direction of the driving means until said means has displaced the pressing means from its upper starting position to its lower end position, with simultaneous pressing of the labels on the articles to be labelled, and
3. re-reversing the moving direction of the driving means to return the means used to vertically displace the pressing means and thus, the pressing means to its starting position.

In a preferred embodiment of the method according to the invention, the conveyor means is stopped between the processing steps 1. and 2. and/or 2. and 3. for 0 to 1 second.

The method according to the invention is advantageous in that its implementation is easy and convenient and that only one driving unit is required. The method is efficient in terms of energy, and no pressurized air must be provided to press on the labels. Not more than one unit has to be controlled by a control.

With reference to the FIGS. 1 and 2, the invention will be illustrated below. These illustrations are given merely by way of example and do not limit the general idea of the invention.

Figure 1:
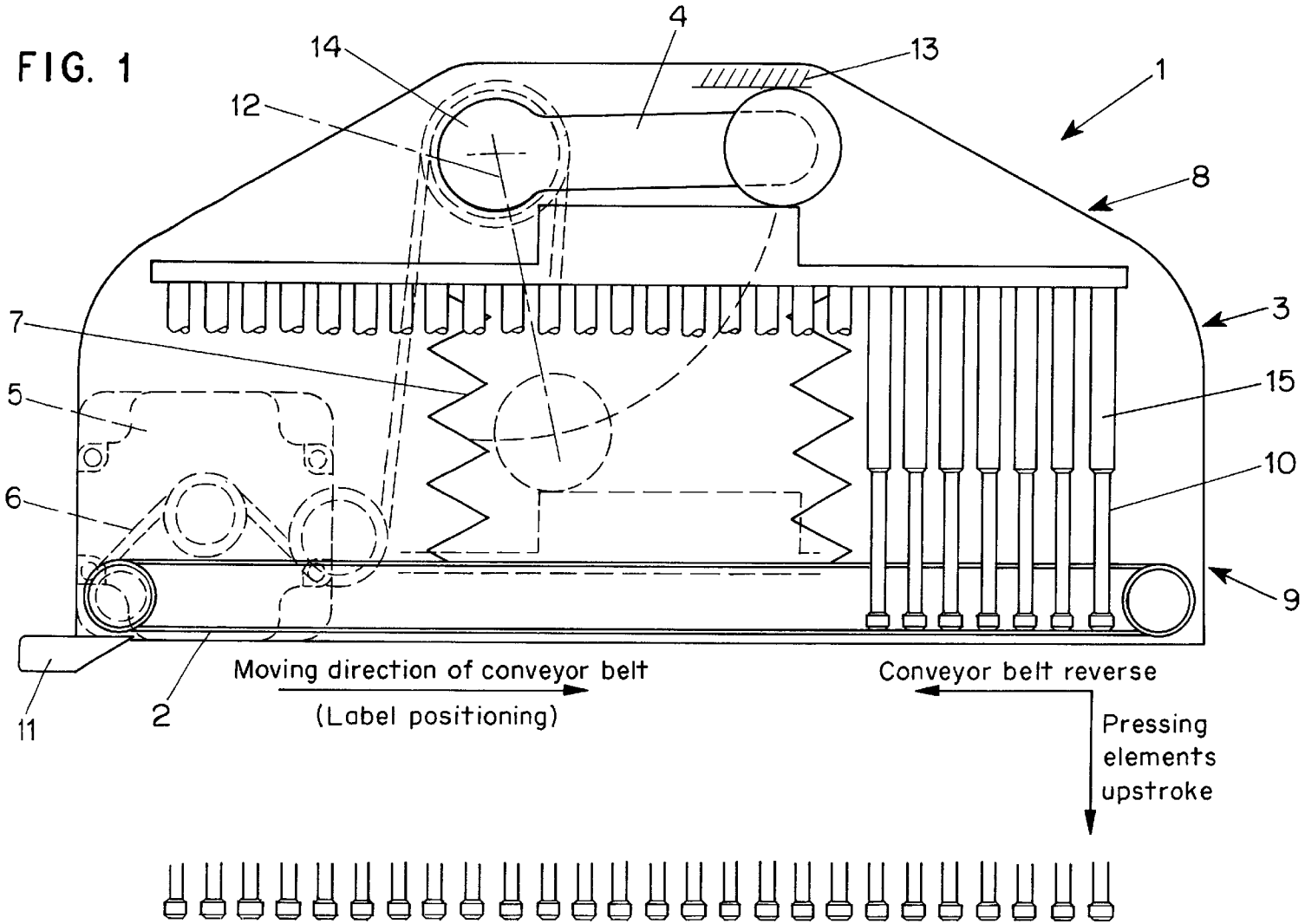
FIG. 1 shows a schematic diagram of the set-down box according to the invention.

FIG. 1 illustrates the set-down box according to the invention. The articles to be packaged are passed in cycles, vertical to the paper plane, underneath the set-down box of the invention. The feed of the articles is stopped during labelling. The labels are detached from the label dispenser at the tear-off edge 11 of the label dispenser and passed on to the conveyor means. As a rule, several articles to be packaged come to lie side by side and therefore, several labels must be passed on to the conveyor means each cycle. The adhesive side of the labels faces away from the conveyor belt. The conveyor means in this case consists of several conveyor belts arranged at a distance relative to each other so as to allow downward displacement of the plungers 10 of the pressing plate 3 between the conveyor belts 2 and therethrough in order to detach the labels from the conveyor belt and press them on the articles to be labelled. A stream of air generated by a ventilator (not shown) presses the labels against the conveyor belts. The conveyor belts 2 are driven by motor 5 via toothed belt 6. The toothed belt not only drives the conveyor belts but also the driving means 4, which is a cam. The cam runs on a bearing so as to be rotatable about axis 12 and has a free-wheel 14 in the moving direction of the conveyor belts (label positioning). In its starting position, the cam 4 makes close contact with stop 13. The moving direction of the conveyor belts is indicated by the arrow. Owing to the free-wheel 14, the toothed belt 6 will transmit no or just a very small torque to cam 4 in this direction of movement. Once the labels have reached their position, the moving direction of motor 5 is reversed, so that the toothed belt 6 will cause the cam 4 to rotate downwardly in a clockwise fashion, thereby displacing the pressing plate 3 from its upper starting position 8 to its lower end position 9. The plungers detach the respective labels from the conveyor belts and press them against the articles to be labelled, thereby forming a firm bond between label and article. Once the pressing plate has reached its end position, the motor stops again and its direction of rotation is re-reversed, so that the cam 4 rotates upwardly in an anti-clockwise fashion back to stop 13. As soon as cam 4 has reached this position, the free-wheel 14 takes effect again, so that the toothed belt will exert no or just a very small torque on cam 4. Simultaneously, the pressing plate 3 is displaced back in its starting position by springs 7. Likewise simultaneously, or a short time thereafter, the next cycle begins, and once again, labels are passed on to the conveyor belts and placed in position by same. Those skilled in the art will recognize that during rotation of the cam from its starting position to its end position, the conveyor belts and thus, the labels are displaced to the left by some millimeters (conveyor belt reverse). However, this backward movement either is negligible or can be accounted for and thus, compensated by the computer control of the motor during label positioning.

Figure 2:
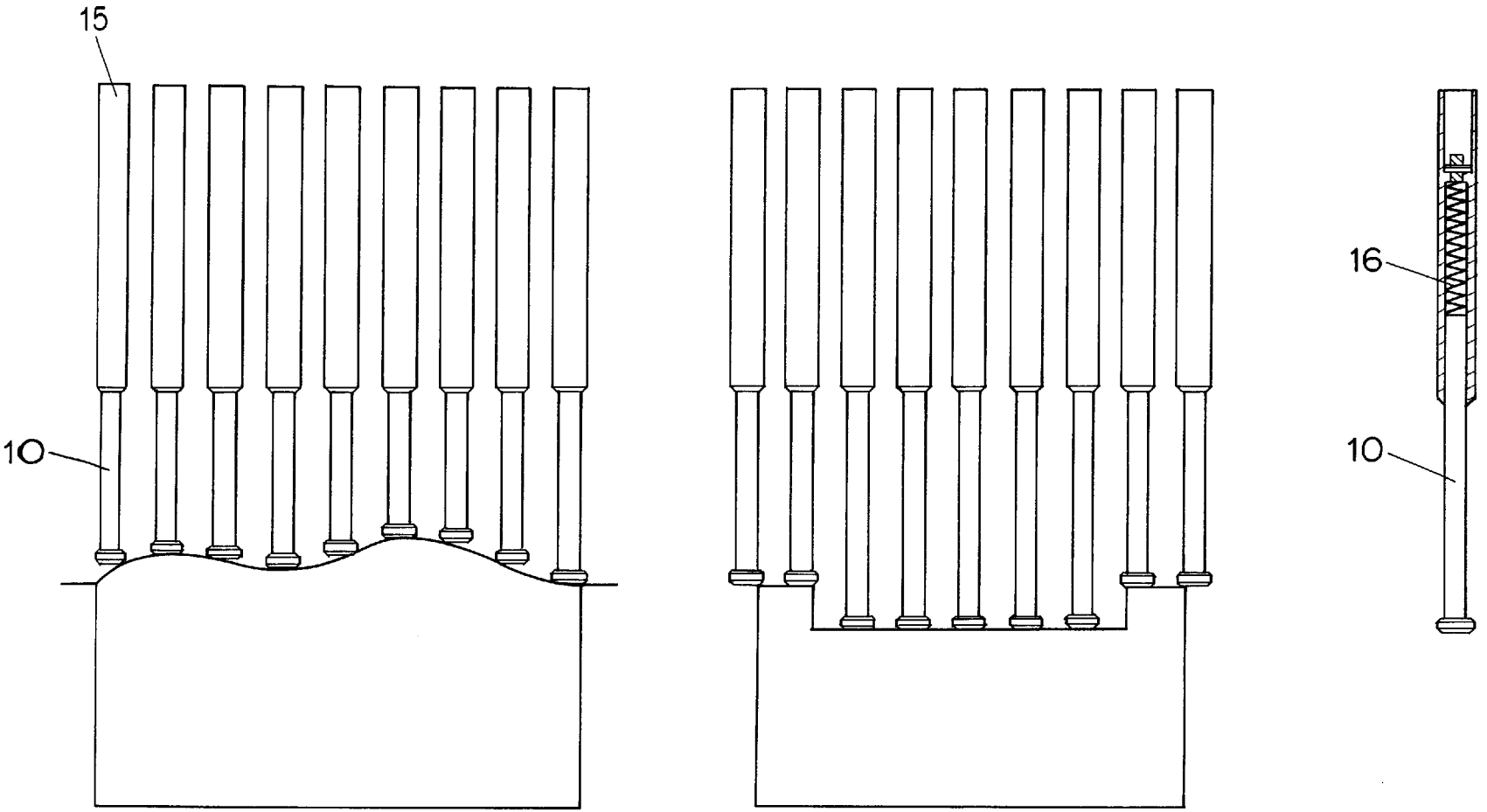
FIG. 2 shows the operation of the plungers of the pressing plate of the invention, as well as a preferred embodiment of a plunger.

FIG. 2 shows the operation of plunger 10. A shell 15 is firmly joined to a plate (not shown). A plunger 10 is mounted displaceably in said shell. The plunger is in connection with spring 16. Owing to the sprung bearing of the plungers, it is possible to compensate unevenness on the articles to be packaged, so that the contact pressure is optimum everywhere. Those skilled in the art will recognize that the pressing plate of the invention not only has one but preferably multiple series of plungers arranged in line in the paper plane.

What is claimed is:

1. A set-down box of a labeling machine for use with labels and with respect to articles to be labeled, including:

a conveyor means used to place the labels over the articles to be labeled;

a vertically displaceable pressing means used to press the labels on the articles to be labeled;

a displacing means used to vertically displace the pressing means;

a motor with clockwise and anti-clockwise rotation; and a driving means transmitting the driving power of the motor to the conveyor means and to the displacing means;

wherein the displacing means has a free-wheel in one direction of rotation of the motor.

2. The set-down box according to claim 1, characterized in that the driving means is a toothed belt or a chain.

3. The set-down box according to claim 1, characterized in that a return spring is mounted on the pressing means.

4. The set-down box according to claim 1, characterized in that the conveyor means consists of multiple conveyor belts arranged at a distance of from 2 to 10 mm relative to each other.

5. The set-down box according to claim 1, characterized in that the pressing means has a vertical guide.

6. The set-down box according to claim 1, characterized in that the displacing means is a cam.

7. The set-down box according to claim 1, characterized in that the pressing means is a pressing plate having attached thereto a plurality of plungers displaceable relative to said pressing plate.

8. The set-down box according to claim 1, characterized in that the pressing means is a pressing plate having attached thereto a plurality of plungers displaceable relative to said pressing plate and said plungers are sprung in bearings.

9. The set-down box according to claim 1, characterized in that the motor is a computer-controlled stepper motor.

10. A method of attaching labels on articles to be labeled using a set-down box of a labeling machine, including:

a conveyor means used to place the labels over the articles to be labeled;

a vertically displaceable pressing means used to press the labels on the articles to be labeled;

a displacing means used to vertically displace the pressing means;

a motor with clockwise and anti-clockwise rotation; and a driving means transmitting the driving power of the motor to the conveyor means and to the displacing means;

wherein the displacing means has a free-wheel in one direction of rotation of the motor, characterized in that said method consists of a succession of the following steps:

positioning the labels over the articles to be labeled using the conveyor means driven by motor;

reversing the moving direction of the driving means until the displacing means has displaced the pressing means from its upper starting position to its lower end position, with simultaneous pressing of the labels on the articles to be labeled; and re-reversing the moving direction of the driving means to return the displacing means and thus, the pressing means to its starting position.

11. The method according to claim 10, characterized in that the conveyor means is stopped briefly between the positioning step and the reversing step and/or between the reversing step and the re-reversing step.

* * * * *